US011447946B2

(12) United States Patent
Duffield

(10) Patent No.: US 11,447,946 B2
(45) Date of Patent: Sep. 20, 2022

(54) PORTABLE SHELTER

(71) Applicant: Duffield Marine, Inc., Costa Mesa, CA (US)

(72) Inventor: Marshall Duffield, Newport Beach, CA (US)

(73) Assignee: Duffield Marine, Inc., Costa Mesa, CA (US)

( * ) Notice: Subject to any disclaimer, the term of this patent is extended or adjusted under 35 U.S.C. 154(b) by 0 days.

(21) Appl. No.: 17/027,095

(22) Filed: Sep. 21, 2020

(65) Prior Publication Data

US 2021/0310234 A1 Oct. 7, 2021

Related U.S. Application Data

(60) Provisional application No. 63/004,629, filed on Apr. 3, 2020.

(51) Int. Cl.

| | |
|---|---|
| ***E04B 7/04*** | (2006.01) |
| ***E04B 1/343*** | (2006.01) |
| ***E04C 2/296*** | (2006.01) |
| ***E04H 1/12*** | (2006.01) |
| *E04C 2/00* | (2006.01) |

(52) U.S. Cl.

CPC ..... *E04B 1/34321* (2013.01); *E04B 1/34384* (2013.01); *E04C 2/296* (2013.01); *E04H 1/1205* (2013.01); *E04B 2001/34389* (2013.01); *E04B 2103/04* (2013.01); *E04C 2002/004* (2013.01)

(58) Field of Classification Search

CPC ... E04H 1/1205; E04C 2/296; E04B 1/34384; E04B 1/34321

USPC ..... 52/91.3

See application file for complete search history.

(56) References Cited

U.S. PATENT DOCUMENTS 3,177,618 A * 4/1965 Jacob ..... E04B 7/22 52/91.3
3,675,380 A * 7/1972 Moss ..... E04B 1/3211 52/81.4
5,398,465 A * 3/1995 Tagg ..... E04H 1/1216 4/449

(Continued)

OTHER PUBLICATIONS

Google Shopping, prefabricated portable shelter, webpage <https://www.google.com/search?q=prefabricated+portable+shelter&sa=X&rlz=1C1CHBD_enUS881US881&tbm=shop&sxsrf=ALeKk037_D0fllM5teqMS-xXUYDb7QgwPA:1609977146548&tbs=vw:g&ved=0ahUKEwiM8qmfwljuAhXFoFsKHYGoBDgQvQ0ljQQ&biw=1416&bih=779>, Dec. 31, 2020, 10 pages.

(Continued)

*Primary Examiner* — Basil S Katcheves

(74) *Attorney, Agent, or Firm* — Stetina Brunda Garred and Brucker

(57) ABSTRACT

A portable shelter includes one or more floor panels, a plurality of exterior wall panels, and one or more roof panels. Each of the floor panels defines a plurality of floor panel apertures. Each of the exterior wall panels has a first wall flange that abuts a floor panel from among the one or more floor panels and defines a plurality of first flange apertures that align with the plurality of floor panel apertures of the floor panel. Each of the floor, exterior wall, and roof panels includes a foam core and two fiberglass sheets sandwiching the foam core. A plurality of threaded fasteners may be inserted through the one or more floor panels and the flanges of the plurality of exterior wall panels via the aligned pluralities of apertures.

21 Claims, 6 Drawing Sheets

(56) References Cited

U.S. PATENT DOCUMENTS 5,921,043 A * 7/1999 McDonald ..... E04H 1/1205 52/309.9
6,131,343 A * 10/2000 Jackson, Jr. ..... E04H 9/14 52/86
6,581,337 B1 * 6/2003 Skov ..... E04B 1/34315 52/79.5
6,701,678 B1 * 3/2004 Skov ..... A47F 5/0815 403/326
8,069,820 B2 * 12/2011 Anderson ..... A01K 1/033 119/498
2005/0210766 A1 * 9/2005 Mower ..... E04B 1/34321 52/79.5
2007/0157890 A1 * 7/2007 Kaura ..... A01K 1/0035 119/496
2010/0050556 A1 * 3/2010 Burns ..... E04B 1/34321 52/592.1
2012/0085049 A1 * 4/2012 Schiffmann ..... B29C 33/44 52/293.1
2012/0102847 A1 * 5/2012 Kopp ..... E04H 1/1205 52/79.1
2012/0110926 A1 * 5/2012 Phillips ..... E04H 1/1205 52/79.9
2012/0222367 A1 * 9/2012 Wirtz ..... E04H 9/10 52/79.1
2012/0266544 A1 * 10/2012 Lazarovits ..... A47B 83/00 52/79.1
2014/0283463 A1 * 9/2014 Vogler ..... E04B 1/34384 52/79.1
2015/0089891 A1 * 4/2015 Schiffmann ..... B29C 70/086 52/309.1
2018/0002939 A1 * 1/2018 Harve ..... A01K 1/033

OTHER PUBLICATIONS

E-Pack Polymers Private Limited, Shelter, webpage <https://www.prefabricated-houses.com/shelter.html>, Dec. 31, 2020, 6 pages.
CID Associates, Inc., Modular & Portable Shelters Manufacturer, webpage <https://www.cidbuildings.com/modular-shelters.html>, Dec. 31, 2020, 8 pages.
Sweetwater Bungalows, Portable Structures: Portable Buildings, Portable Housing, Portable Shelter, webpage <https://www.sweetwaterbungalows.com>, Dec. 31, 2020, 3 pages.
World Housing Solution, Rapidly Deployable Portable Shelters & Shelter Systems, webpage <https://www.worldhousingsolution.com/rapidly-deployable-shelters/>, Dec. 31, 2020, 9 pages.
Par-Kut International, Prefabricated Shelters, webpage <https://parkut.com/products/shelters/prefabricated-steel-shelters/>, Dec. 31, 2020, 2 pages.

* cited by examiner

PORTABLE SHELTER

CROSS-REFERENCE TO RELATED APPLICATIONS

This application relates to and claims the benefit of U.S. Provisional Application No. 63/004,629 filed Apr. 3, 2020, the entire contents of which is expressly incorporated herein by reference.

STATEMENT RE: FEDERALLY SPONSORED RESEARCH/DEVELOPMENT

Not Applicable

BACKGROUND

1. Technical Field

The present disclosure relates to portable shelters such as may be used for temporary housing of homeless populations.

2. Related Art

With homeless populations on the rise in the United States, and the resulting significant humanitarian and public health concerns, state and local municipalities have sought to provide safe, economic housing that may be used on a temporary basis. Unfortunately, conventional building materials and construction techniques make it difficult to achieve these competing goals, with the durability and safety of such housing often at odds with efforts to reduce the cost and/or weight of the structure.

BRIEF SUMMARY

The present disclosure contemplates various apparatuses, systems, and methods for overcoming the above drawbacks accompanying the related art. One aspect of the embodiments of the present disclosure is a portable shelter. The portable shelter may comprise one or more floor panels, a plurality of exterior wall panels, and one or more roof panels. Each of the floor panels may define a plurality of floor panel apertures. Each of the exterior wall panels may have a first wall flange that abuts a floor panel from among the one or more floor panels and defines a plurality of first flange apertures that align with the plurality of floor panel apertures of the floor panel. Each of the floor, exterior wall, and roof panels may include a foam core and two fiberglass sheets sandwiching the foam core.

The plurality of exterior wall panels may include two or more side wall panels. Each of the side wall panels may have a second wall flange that abuts the second wall flange of an adjacent side wall panel from among the two or more side wall panels, each of the second wall flanges defining a plurality of second flange apertures that align with the second flange apertures of the second wall flange of the adjacent side wall panel. Each of the roof panels may define a plurality of roof panel apertures. Each of the two or more side wall panels may have a third wall flange defining a plurality of third flange apertures that align with the plurality of roof panel apertures of a roof panel from among the one or more roof panels. The plurality of exterior wall panels may include two or more end panels that define respective gables. Each of the end panels may define a plurality of end panel apertures. Each of the two or more side wall panels may have a fourth wall flange that abuts an end panel from among the two or more end panels and defines a plurality of fourth flange apertures that align with the plurality of end panel apertures of the end panel.

The plurality of exterior wall panels may comprise a first side wall panel, a second side wall panel connected to and coplanar with the first side wall panel, a first end panel connected to and perpendicular to the second side wall panel, a third side wall panel connected to and perpendicular to the first end panel and parallel to the first and second side wall panels, a fourth side wall panel connected to and coplanar with the third side wall panel, and a second end panel connected to and perpendicular to the first side wall panel and the fourth side wall panel. The one or more roof panels may comprise a first roof panel connected to the first side wall panel, a second roof panel connected to the second side wall panel, a third roof panel connected to the third side wall panel and the second roof panel, and a fourth roof panel connected to the fourth side wall panel and the first roof panel. A total weight of the one or more floor panels, the plurality of exterior wall panels, and the one or more roof panels may be under 500 pounds.

Each of the floor panels may have a floor flange that extends downward to raise the floor panel off an underlying ground or support surface.

The portable shelter may further comprise one or more threaded feet operable to adjust an elevation of the one or more floor panels off an underlying ground or support surface.

At least one of the exterior wall panels may define a door opening.

The portable shelter may further comprise a solar panel disposed on the one or more roof panels.

The portable shelter may further comprise a plurality of threaded fasteners fastening the one or more floor panels to the flanges of the plurality of exterior wall panels via the aligned pluralities of apertures. The plurality of threaded fasteners may comprise a plurality of bolts and corresponding nuts.

Another aspect of the embodiments of the present disclosure is a method of assembling a portable shelter. The method may comprise providing a floor panel and an exterior wall panel, the floor panel and the exterior wall panel each including a foam core and two fiberglass sheets sandwiching the foam core, aligning a plurality of apertures defined by the floor panel with a plurality of apertures defined by a flange of the exterior wall panel, and inserting a threaded fastener through the floor panel and the flange of the exterior wall panel via the aligned pluralities of apertures.

The flange of the exterior wall panel may be a first flange of a plurality of flanges of the exterior wall panel. The method may further comprise providing another exterior wall panel including a foam core and two fiberglass sheets sandwiching the foam core, aligning a plurality of apertures defined by a flange of the another exterior wall panel with a plurality of apertures defined by a second flange of the plurality of flanges of the exterior wall panel, and inserting a threaded fastener through the flange of the another exterior wall panel and the second flange of the exterior wall panel via the aligned pluralities of apertures. The method may further comprise providing a roof panel including a foam core and two fiberglass sheets sandwiching the foam core, aligning a plurality of apertures defined by the roof panel with a plurality of apertures defined by a third flange of the plurality of flanges of the exterior wall panel, and inserting a threaded fastener through the roof panel and the third flange of the exterior wall panel via the aligned pluralities of apertures. The method may further comprise providing an end panel including a foam core and two fiberglass sheets sandwiching the foam core, aligning a plurality of apertures defined by the end panel with a plurality of apertures defined by a fourth flange of the plurality of flanges of the exterior wall panel, and inserting a threaded fastener through the end panel and the fourth flange of the exterior wall panel via the aligned pluralities of apertures.

Another aspect of the embodiments of the present disclosure is an exterior wall panel for use in assembling a portable shelter. The exterior wall panel may comprise a foam core and two fiberglass sheets sandwiching the foam core, one of the two fiberglass sheets having one or more flanges that extend perpendicular to the fiberglass sheet, the one or more flanges defining a plurality of spaced apertures.

The one or more flanges may extend about an entire perimeter of the fiberglass sheet.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of portable shelters and assembly methods and components thereof. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
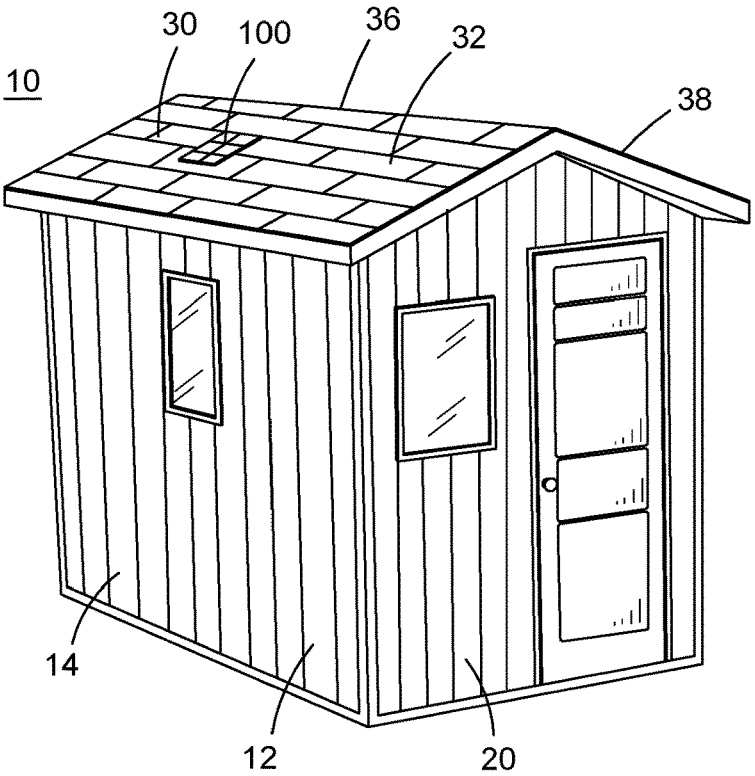
FIG. 1 is a left-side perspective view of a portable shelter according to an embodiment of the present disclosure.
Figure 2:
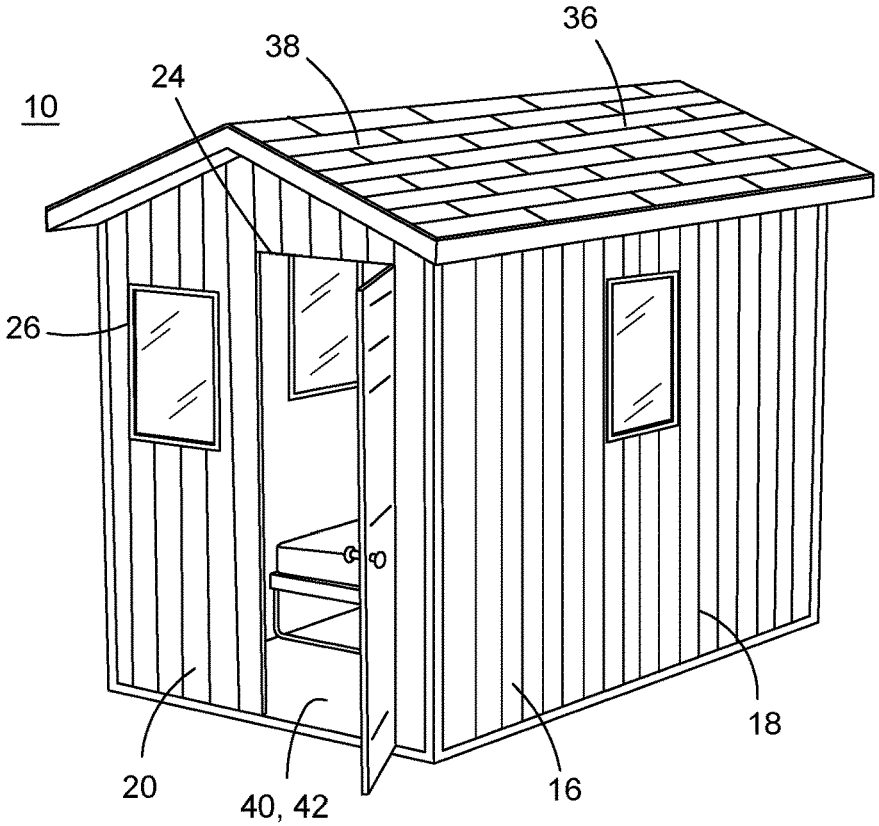
FIG. 2 is a right-side perspective view of the portable shelter with the door open.
Figure 3:
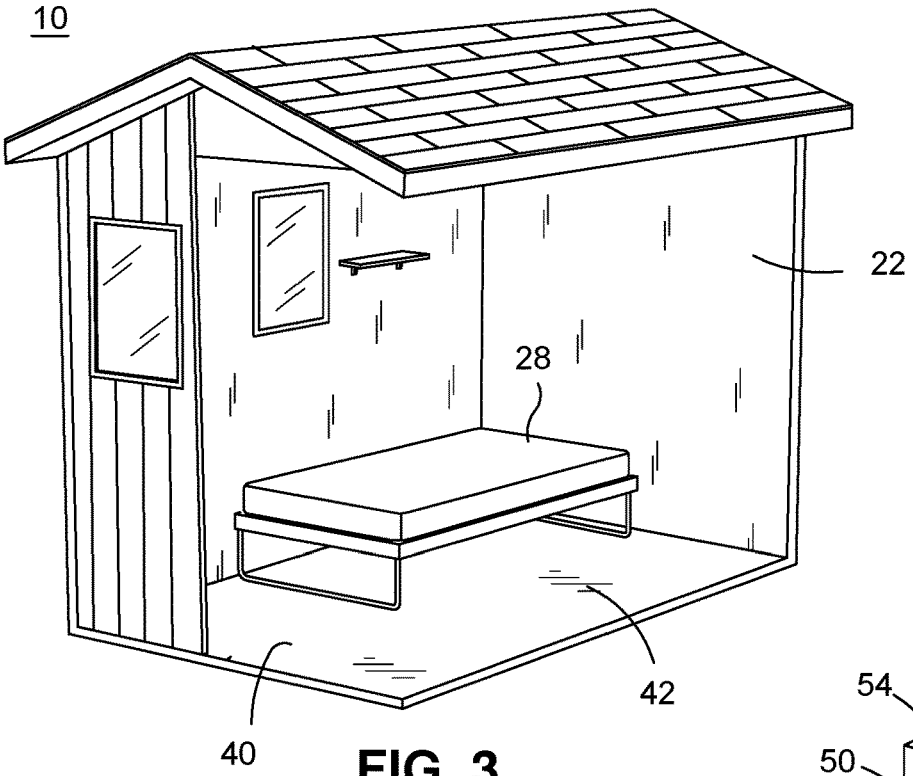
FIG. 3 is a partial right-side perspective view of the portable shelter showing the interior thereof with a folding bed in a deployed position.
Figure 4:
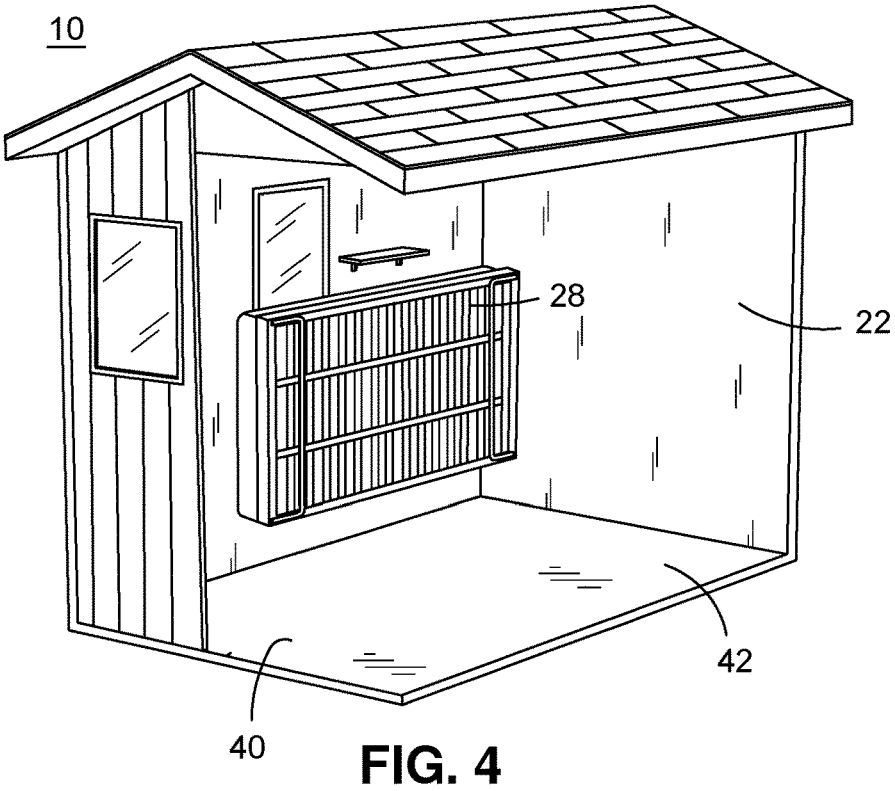
FIG. 4 is a partial right-side perspective view of the portable shelter showing the interior thereof with the folded bed in a stowed position.

FIG. 1 is a left-side perspective view of a portable shelter 10 according to an embodiment of the present disclosure. FIG. 2 is a right-side perspective view of the portable shelter 10 with the door open. FIG. 3 is a partial right-side perspective view of the portable shelter 10 showing the interior thereof with a folding bed 28 in a deployed position, and FIG. 4 is the same view with the folded bed 28 in a stowed position. The portable shelter 10, which is shown in an assembled configuration in FIGS. 1 through 4, may be assembled from one or more floor panels 40, 42, a plurality of exterior wall panels 12, 14, 16, 18, 20, 22, and one or more roof panels 30, 32, 36, 38. Each of the panels to be assembled into the portable shelter 10 may be formed from fiberglass foam core panel material and the panels may be connectable together utilizing flanges and standard threaded fasteners. Due to its panel construction, the shelter can be shipped disassembled in a flat configuration and easily assembled on site within two hours and without the use of nails, glue or trim pieces. The resulting assembled portable shelter 10 may be inexpensive, light weight (e.g. under 500 pounds), and durable, meeting or exceeding building code standards for snow, wind and earthquake loads and stress.

Although not by way of limitation, there may be, for example, twelve separate panels that are assembled together utilizing conventional screw fasteners with a caulking or gasket material positioned between adjacent panel connections to prevent water intrusion. Due to its fiberglass/foam panel construction, both inside and outside surfaces of the portable shelter 10 can be quickly and easily disinfected and sanitized via conventional spray/power washing cleaning techniques. Due to a gel coating on the fiberglass exterior and interior surfaces, the panels will not rot or deteriorate over time, nor will they require painting or maintenance.

As shown in FIGS. 1 through 4, for example, the exterior wall panels may include two or more interconnected side panels 12, 14 (see FIG. 1) defining one side of the portable shelter 10 and two or more interconnected side panels 16, 18 (see FIG. 2) defining an opposite side of the portable shelter 10 parallel thereto. The exterior wall panels may further include two or more end panels 20, 22 that connect the two sets of interconnected side panels 12, 14, 16, 18 to form a rectangular structure. In the example shown, a single end panel 20 connects the side panel 12 to the side panel 16 to define a front of the portable shelter 10, and a single end panel 22 connects the side panel 14 to the side panel 18 to define a back of the portable shelter 10 parallel to the front. Thus, as illustrated, the plurality of exterior wall panels may comprise, in clockwise fashion about the perimeter of the structure, a first side wall panel 12, a second side wall panel 14 connected to and coplanar with the first side wall panel 12, a first end panel 22 connected to and perpendicular to the second side wall panel 14, a third side wall panel 18 connected to and perpendicular to the first end panel 22 and parallel to the first and second side wall panels 12, 14, a fourth side wall panel 16 connected to and coplanar with the third side wall panel 18, and a second end panel 20 connected to and perpendicular to the first side wall panel 12 and the fourth side wall panel 16. The one or more roof panels 30, 32, 36, 38 may be assembled to form a pitched roof as shown, with the end panels 20, 22 defining respective gables. The one or more roof panels 30, 32, 36, 38 may comprise, for example, a first roof panel 32 connected to the first side wall panel 12, a second roof panel 30 connected to the second side wall panel 14, a third roof panel 36 connected to the third side wall panel 18 and the second roof panel 30, and a fourth roof panel 38 connected to the fourth side wall panel 16 and the first roof panel 32. Serving as a base for the entire structure may be one or more interconnected floor panels 40, 42 (see FIGS. 3 and 4).

Figure 5:
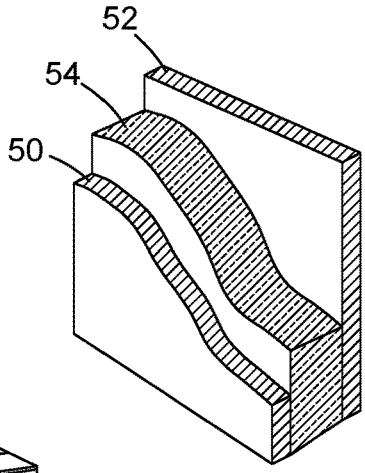
FIG. 5 is a closeup cutaway of a panel of the portable shelter.

FIG. 5 is a closeup cutaway of a panel of the portable shelter 10. As best shown in FIG. 5, each of the side panels 12, 14, 16, 18, end panels 20, 22, roof panels 30, 32, 36, 38 and floor panels 40, 42 may be formed from a fiberglass/foam sandwich structure with an interior fiberglass sheet 50, an exterior fiberglass sheet 52, and a foam core 54. These materials may provide a lightweight, load supporting panel having superior thermal insulation capabilities. The fiberglass of the fiberglass/foam sandwich structure may be formed by a resin infusion process such as a vacuum infusion process, which may benefit the environment by preventing volatile organic compounds (VOCs) from being emitted into the air. However, other molding processes for forming the panels are contemplated as well.

Figure 6:
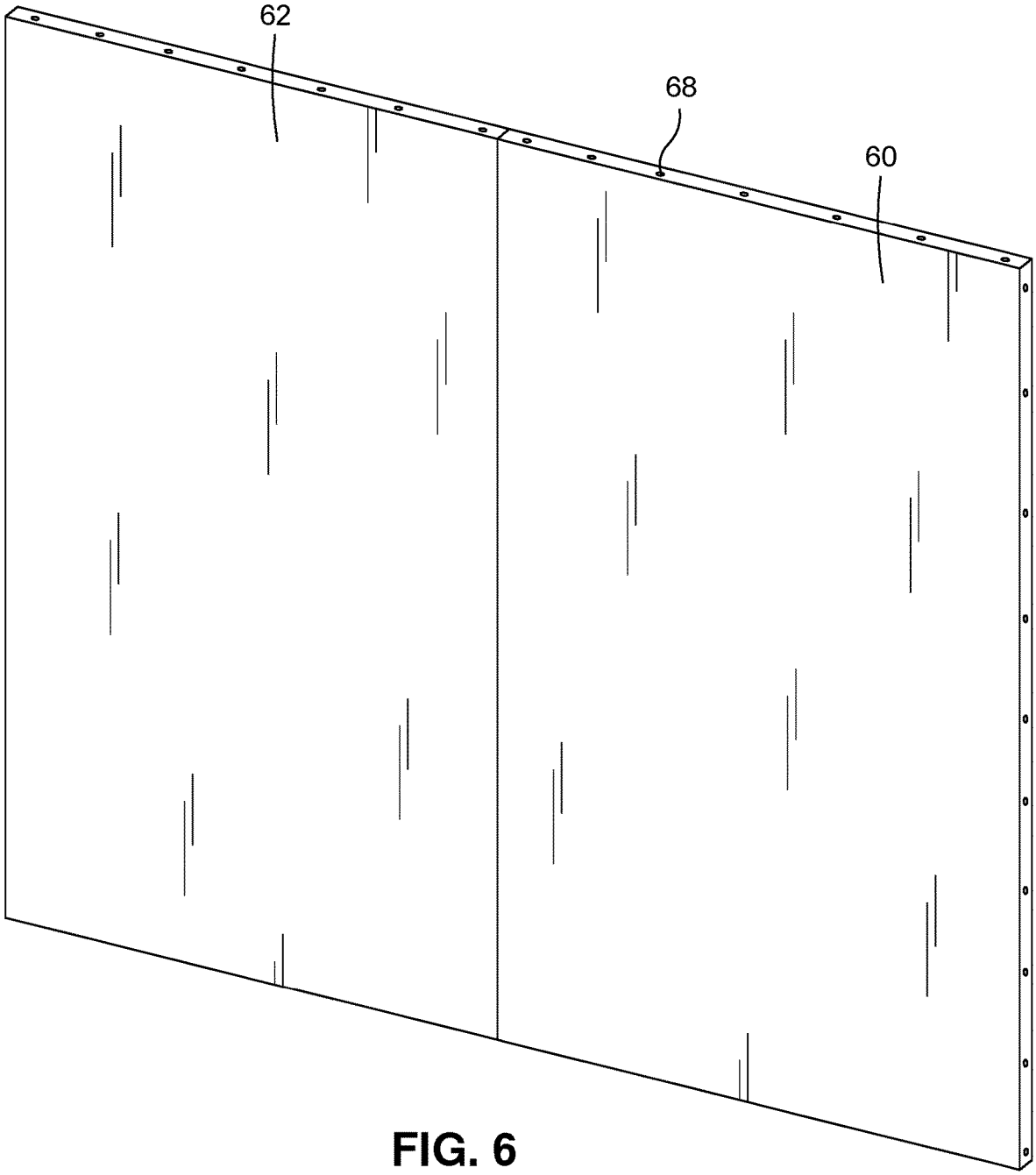
FIG. 6 is a front view of two adjacent side wall panels of the portable shelter.
Figure 7:
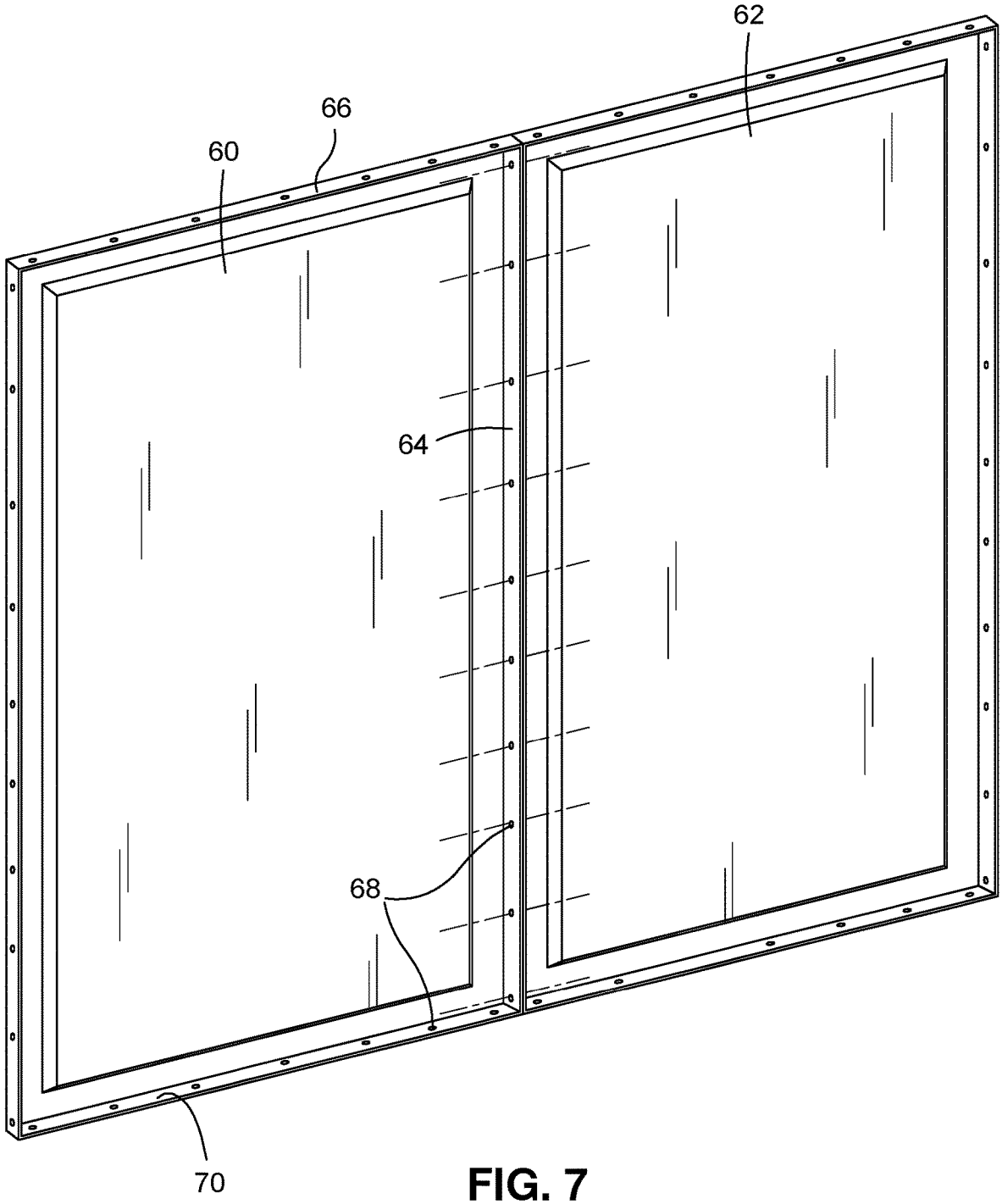
FIG. 7 is a rear view of the two adjacent side wall panels of the portable shelter.

FIG. 6 is a front view of two adjacent side wall panels 60, 62 of the portable shelter 10, and FIG. 7 is a rear view thereof. The adjacent side wall panels 60, 62 may serve as the side wall panels 12, 14 of FIG. 1 or the side wall panels 16, 18 of FIG. 2, for example. While shown with a smooth exterior in FIG. 6, the panels 60, 62 (and likewise any panels used as the side wall or end panels 12, 14, 16, 18, 20, 22) may be formed with a wood grain surface to simulate the aesthetics of conventional wood structures as shown in FIGS. 1 and 2.

As best shown in FIG. 7, each of the side wall panels 60, 62 may include one or more flanges of fiberglass extending generally outward from the interior of the panel. The one or more flanges may extend about an entire perimeter of each side wall panel 60, 62 as shown and may include a lower flange 70 at the bottom, a side flange 64 on each side, and an upper flange 66 at the top. Each of the flanges 70, 64, 66 of the side wall panels 60, 62 may define a plurality of spaced flange apertures 68. As shown, when connecting the adjacent side wall panels 60, 62, the side flange 64 of the side wall panel 60 may abut the side flange 64 of the adjacent side wall panel 62, with the flange apertures 68 of the abutting side flanges 64 aligned with each other as shown. Conventional threaded fasteners (e.g. bolts and nuts) can be utilized to secure the adjacent panels 60, 62 together via the aligned flange apertures 68.

Figure 8:
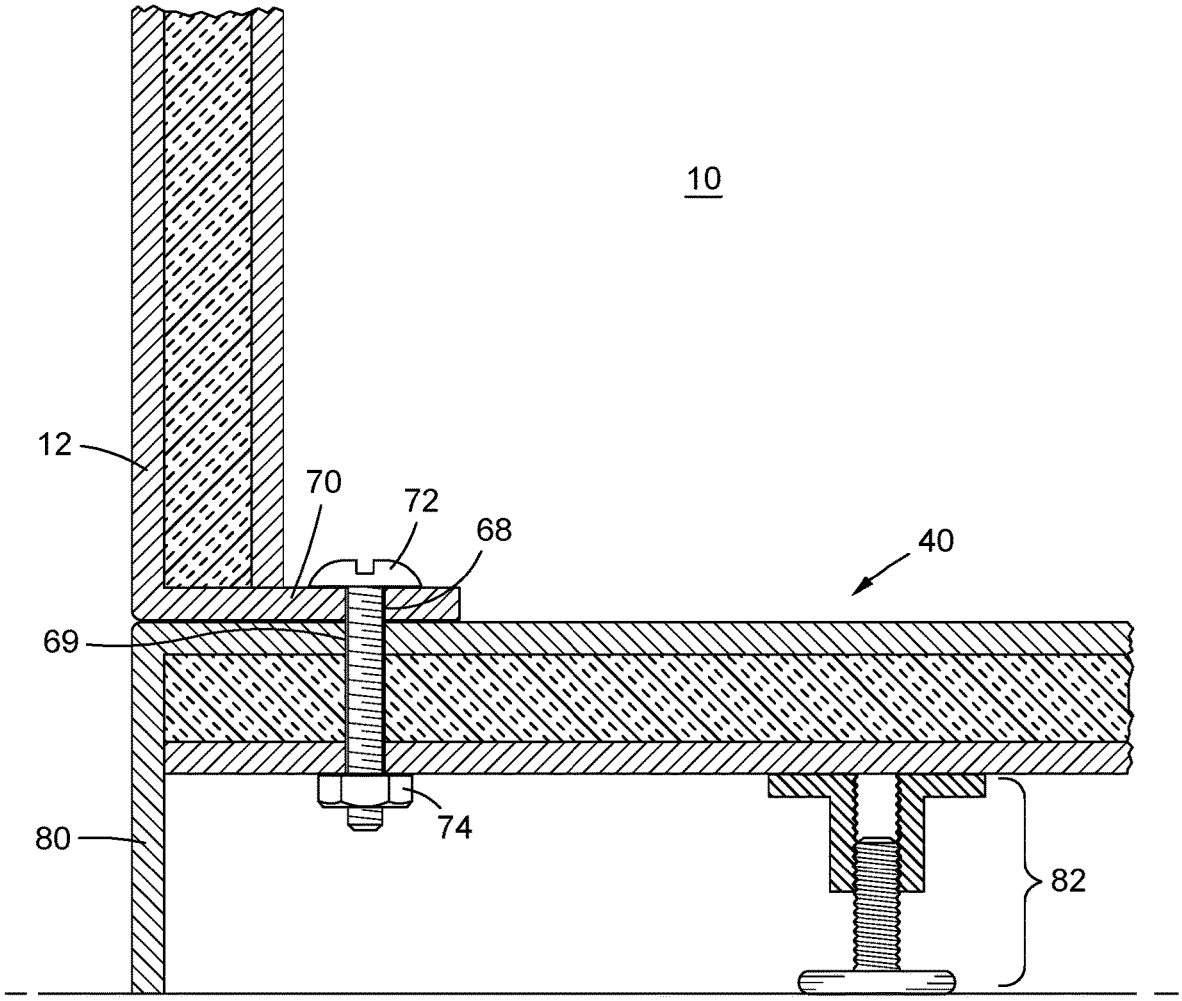
FIG. 8 is a cross sectional view of the portable shelter showing a connection between a side wall panel and a floor panel thereof.

FIG. 8 is a cross sectional view of the portable shelter 10 showing a connection between a side wall panel 12 and a floor panel 40 thereof. The lower portion of each of the side and end panels 12, 14, 16, 18, 20, 22 may include a lower flange 70 or bottom flange as described above in relation to FIG. 7, which rests upon the floor or base panel 40 as shown in FIG. 8. As in the case of fastening together the adjacent side flanges 64 (see FIG. 7), the lower flange 70 may be fastened to the floor panel 40 by inserting conventional threaded fasteners (e.g. the bolt 72 and nut 74 shown in FIG. 8) through the apertures 68 defined by the flange 70. In this case, however, the flange 70 may directly abut the floor panel 40, rather than a flange thereof, as the floor panel 40 itself is parallel to the flange 70. The plurality of apertures 68 of the lower flange 70 may be aligned with a plurality of floor panel apertures 69 defined by the floor panel 40, which may extend through the entire fiberglass foam sandwich structure of the floor panel 40.

Each of the floor panels 40, 42 may include a floor flange 80 that extends downward to raise the floor panel 40, 42 off an underlying ground or support structure. The floor flange 80 may, for example, extend vertically downward about the perimeter of the floor panel 40, 42. In addition, the portable shelter 10 may include one or more threaded feet 82 operable to adjust an elevation of the one or more floor panels 40, 42 off the underlying ground or support surface. The one or more threaded feet 82 may be utilized to adjust for elevational differences in the ground or support surface so that the portable shelter 10 provides a level living space.

A side wall panel 12 is illustrated in FIG. 8. However, it is contemplated that the connection of an end panel 20, 22 to one of the floor panels 40, 42 may be identical, with the apertures 68 formed in the lower flange 70 of the end panel 20, 22 being aligned with the apertures 69 of the floor panel 40, 42 and a threaded fastener being inserted therethrough. It should also be noted that the end panels 20, 22 of the illustrated example of FIGS. 1 through 4 may not include the side flanges 64 as the end panels 20, 22 themselves are parallel to the side flanges 64 of the side wall panels 12, 14, 16, 18. As such, the connection of a side wall panel 12, 14, 16, 18 to one of the end panels 20, 22 may be analogous to the connection of the side wall panel 12, 14, 16, 18 or end panel 20, 22 to the floor panels 40, 42. That is, the apertures 68 formed in the side flange 64 of the side wall panel 12, 14, 16, 18 may be aligned with apertures formed in the end panel 20, 22 and a threaded fastener may be inserted therethrough. In the case of a portable shelter 10 having multiple adjacently connected end panels 20, 22 on each end of the portable shelter 10 (e.g. two end panels in the front and two end panels in the back), such end panels 20, 22 may additionally have side flanges 64 for connection to each other. For example, a side flange 64 may be formed on one side of each end panel 20, 22 and not on the other, with the side having no flange being used for the perpendicular connection of the side panel 20, 22 to the side flange 64 of a side wall panel 12, 14, 16, 18.

Figure 9:
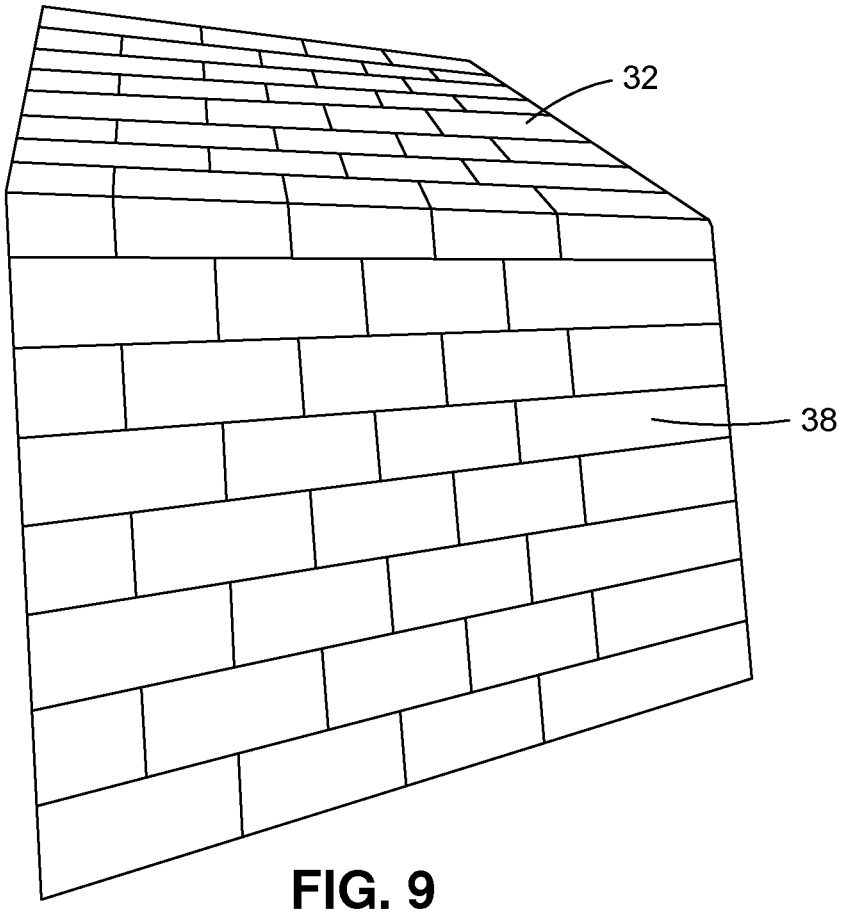
FIG. 9 is a top perspective view of two adjacent roof panels of the portable shelter.
Figure 10:
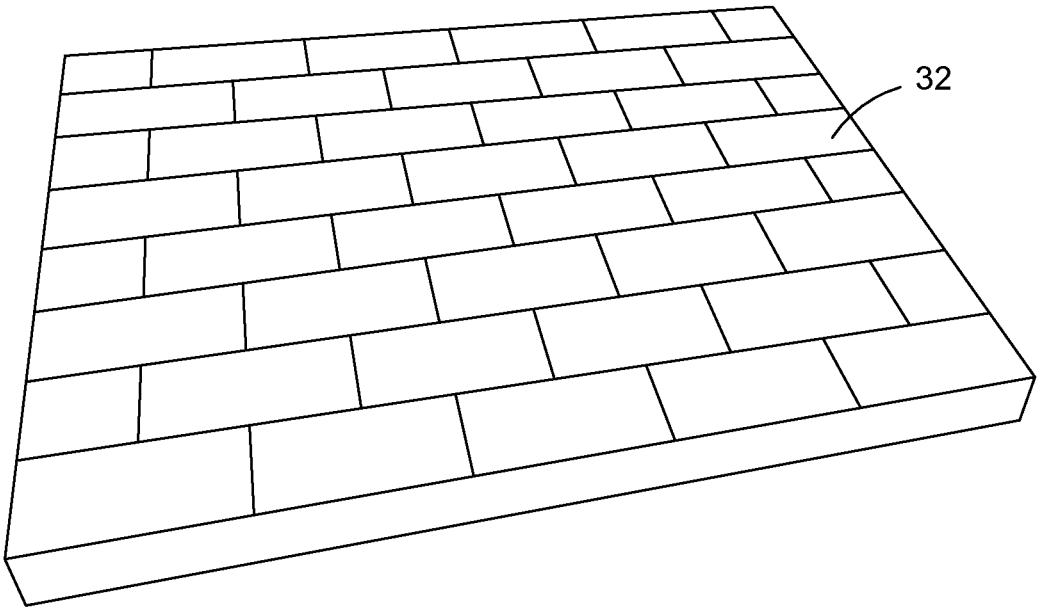
FIG. 10 is a perspective view of one of the roof panels.

FIG. 9 is a top perspective view of two adjacent roof panels 32, 38 of the portable shelter 10, with FIG. 10 being a perspective view of one of the roof panels 32. Each of the roof panels 30, 32, 36, 38, while being made of a fiberglass foam sandwich structure as noted above, may be formed with a surface as shown to simulate the aesthetics of asphalt or other conventional roof materials as shown in FIGS. 9 and 10. The connection of a side wall panel 12, 14, 16, 18 to one of the roof panels 30, 32, 36, 38 may be analogous to the connection of the side wall panel 12, 14, 16, 18 or end panel 20, 22 to the floor panels 40, 42. In this regard, the roof panels 30, 32, 36, 38 may define a plurality of apertures which may be aligned with the apertures 68 of the upper flange 66 of the side wall panel 12, 14, 16, 18. A threaded fastener may then be inserted therethrough to secure each roof panel 30, 32, 36, 38 to one of the side wall panels 12, 14, 16, 18. Because the roof panels 30, 32, 36, 38 may be angled to form a pitched roof as shown in the illustrated example, it is contemplated that there may be a gap between the upper flange 66 of the side wall panel 12, 14, 16, 18 and the roof panel 30, 32, 36, 38. A threaded fastener may be selected that is long enough to cross the gap. Alternatively, a wedge may be placed between the upper flange 66 and the roof panel 30, 32, 36, 38 in order to eliminate the gap. As another possibility, the upper flange 66 may itself be angled upward at an angle to match the angle of the roof panel 30, 32, 36, 38, allowing the upper flange 66 to abut the roof panel 30, 32, 36, 38. The same methods may be used to connect the end panels 20, 22 to the roof panels 30, 32, 36, 38 if desired.

Where the roof panels 30, 32, 36, 38 meet each other, they may be connected together using flanges in an analogous fashion as described above in relation to the other panels. For example, horizontally adjacent roof panels 30 and 32 (see FIG. 1) may be connected to each other by way of abutting flanges and threaded fasteners just like the side flanges 64 of the adjacent side wall panels 60, 62 (see FIG. 7). Roof panels 32, 38 that meet in the center to form the pitched roof may similarly be connected together by way of abutting flanges and threaded fasteners. For example, the flanges may be angled relative to the roof panels 32, 38 so that the flanges are in parallel with each other and abutting while the roof panels 32, 38 are at the desired angle relative to each other.

A door, windows or optional bed may be incorporated into the shelter as illustrated in FIGS. 1 through 4. For example, at least one of the exterior wall panels 12, 14, 16, 18, 20, 22 may define a door opening 24 (see FIG. 2), which may accommodate a hinged door. One or more window openings 26 may also be provided as shown for accommodating openable or non-openable windows. The bed 28 (see FIGS. 3 and 4) may include an operative horizontal position or a stowed vertical position as indicated. As shown in FIG. 1, a solar panel 100 may be mounted to any one or more of the roof panels 32, 34, 36, 38 to provide solar power to the portable shelter 10 for lighting or other electrical power requirements.

Owing to the flanged panel construction described above, no nails, glue or trim pieces are required to assemble the portable shelter 10. The various exterior wall, floor, and roof panels 12, 14, 16, 18, 20, 22, 30, 32, 36, 38, 40, 42 may be easily assembled and disassembled as needed with the use of ordinary threaded fasteners. When in a disassembled state, the panels may be cost effectively shipped as they can simply be stacked on a truck, for example. Additionally, due to their fiberglass construction, the inside and outside surfaces of all the panels are waterproof and thereby facilitate a safe, fast and inexpensive way to disinfect and sanitize the portable shelter 10. The portable shelter 10 may exceed typical building code standards for snow, wind, rain and earthquake resistance, and, owing to a gel coat, for example, the fiberglass panels will not require painting or other maintenance. It has been found that due to the fiberglass/foam structure of the individual panels, the overall weight of the portable shelter 10 may be under 500 pounds, e.g. approximately 450 pounds with the dimensions of the shelter being a six-feet by ten-feet floor plan with an eight-feet ceiling height at its peak. The portable shelter 10 is secure and stout for providing safe, inexpensive and sustainable shelter particularly adapted for homeless populations, while being easily erected and disassembled and transported as desired.

In the illustrated example of the portable shelter 10, each of the side panels 12, 14, 16, 18 may be an approximately five-feet by seven-feet rectangle, for example, with each of the end panels 20, 22 being an approximately six-feet by seven-feet rectangle, discounting the gable portion. Each of the floor panels 40, 42 may be an approximately five-feet by six-feet rectangle, and each of the roof panels 30, 32, 36, 38 may be an approximately five-feet by four-feet rectangle, for example, depending on the desired height of the pitched roof. Although particular materials and sizing have been defined in this application by way of example, those skilled in the art will recognize that the disclosed portable shelter 10 is not limited thereby, and that various modifications of the same can be made without departing from the spirit of the present disclosure. For example, the number of panels and their particular arrangement may vary depending on the desired size and shape of the portable shelter.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A portable shelter comprising:

one or more floor panels, each of the floor panels defining a plurality of floor panel apertures;

a plurality of exterior wall panels, each of the exterior wall panels having a first wall flange that abuts a floor panel from among the one or more floor panels and defines a plurality of first flange apertures that align with the plurality of floor panel apertures of the floor panel, the first wall flange having a first portion parallel to the exterior wall panel and a second portion perpendicular to the exterior wall panel, the second portion of the first wall flange defining the plurality of first flange apertures; and one or more roof panels, wherein each of the floor, exterior wall, and roof panels includes a foam core and two fiberglass sheets sandwiching the foam core.

2. The portable shelter of claim 1, wherein the plurality of exterior wall panels includes two or more side wall panels, and each of the side wall panels has a second wall flange that abuts the second wall flange of an adjacent side wall panel from among the two or more side wall panels, each of the second wall flanges defining a plurality of second flange apertures that align with the second flange apertures of the second wall flange of the adjacent side wall panel, the second wall flange having a first portion parallel to the side wall panel and a second portion perpendicular to the side wall panel, the second portion of the second wall flange defining the plurality of second flange apertures.

3. The portable shelter of claim 2, wherein each of the roof panels defines a plurality of roof panel apertures, and each of the two or more side wall panels has a third wall flange defining a plurality of third flange apertures that align with the plurality of roof panel apertures of a roof panel from among the one or more roof panels.

4. The portable shelter of claim 3, wherein the plurality of exterior wall panels includes two or more end panels that define respective gables.

5. The portable shelter of claim 4, wherein each of the end panels defines a plurality of end panel apertures, and each of the two or more side wall panels has a fourth wall flange that abuts an end panel from among the two or more end panels and defines a plurality of fourth flange apertures that align with the plurality of end panel apertures of the end panel.

6. The portable shelter of claim 1, wherein the plurality of exterior wall panels comprises:

a first side wall panel;

a second side wall panel connected to and coplanar with the first side wall panel;

a first end panel connected to and perpendicular to the second side wall panel;

a third side wall panel connected to and perpendicular to the first end panel and parallel to the first and second side wall panels;

a fourth side wall panel connected to and coplanar with the third side wall panel; and a second end panel connected to and perpendicular to the first side wall panel and the fourth side wall panel.

7. The portable shelter of claim 6, wherein the one or more roof panels comprise:

a first roof panel connected to the first side wall panel;

a second roof panel connected to the second side wall panel;

a third roof panel connected to the third side wall panel and the second roof panel; and a fourth roof panel connected to the fourth side wall panel and the first roof panel.

8. The portable shelter of claim 7, wherein a total weight of the one or more floor panels, the plurality of exterior wall panels, and the one or more roof panels is under 500 pounds.

9. The portable shelter of claim 1, wherein each of the floor panels has a floor flange that extends downward to raise the floor panel off an underlying ground or support surface.

10. The portable shelter of claim 1, further comprising one or more threaded feet operable to adjust an elevation of the one or more floor panels off an underlying ground or support surface.

11. The portable shelter of claim 1, wherein at least one of the exterior wall panels defines a door opening.

12. The portable shelter of claim 1, further comprising a solar panel disposed on the one or more roof panels.

13. The portable shelter of claim 1, further comprising a plurality of threaded fasteners fastening the one or more floor panels to the flanges of the plurality of exterior wall panels via the aligned pluralities of apertures.

14. The portable shelter of claim 13, wherein the plurality of threaded fasteners comprises a plurality of bolts and corresponding nuts.

15. The portable shelter of claim 1, wherein the first wall flange has a ninety degree bend connecting the first portion to the second portion.

16. A method of assembling a portable shelter, the method comprising:

providing a floor panel and an exterior wall panel, the floor panel and the exterior wall panel each including a foam core and two fiberglass sheets sandwiching the foam core;

aligning a plurality of apertures defined by the floor panel with a plurality of apertures defined by a flange of the exterior wall panel, the flange of the exterior wall panel having a first portion parallel to the exterior wall panel and a second portion perpendicular to the exterior wall panel, the second portion defining the plurality of apertures of the flange; and inserting a threaded fastener through the floor panel and the flange of the exterior wall panel via the aligned pluralities of apertures.

17. The method of claim 16, wherein the flange of the exterior wall panel is a first flange of a plurality of flanges of the exterior wall panel, the method further comprising:

providing another exterior wall panel including a foam core and two fiberglass sheets sandwiching the foam core;

aligning a plurality of apertures defined by a flange of the another exterior wall panel with a plurality of apertures defined by a second flange of the plurality of flanges of the exterior wall panel, the second flange of the exterior wall panel having a first portion parallel to the exterior wall panel and a second portion perpendicular to the exterior wall panel, the second portion defining the plurality of apertures of the second flange; and inserting a threaded fastener through the flange of the another exterior wall panel and the second flange of the exterior wall panel via the aligned pluralities of apertures.

18. The method of claim 17, further comprising:

providing a roof panel including a foam core and two fiberglass sheets sandwiching the foam core;

aligning a plurality of apertures defined by the roof panel with a plurality of apertures defined by a third flange of the plurality of flanges of the exterior wall panel; and inserting a threaded fastener through the roof panel and the third flange of the exterior wall panel via the aligned pluralities of apertures.

19. The method of claim 18, further comprising:

providing an end panel including a foam core and two fiberglass sheets sandwiching the foam core;

aligning a plurality of apertures defined by the end panel with a plurality of apertures defined by a fourth flange of the plurality of flanges of the exterior wall panel; and inserting a threaded fastener through the end panel and the fourth flange of the exterior wall panel via the aligned pluralities of apertures.

20. A portable shelter comprising:

one or more floor panels, each of the floor panels defining a plurality of floor panel apertures; and a plurality of exterior wall panels, each of the exterior wall panels comprising a foam core and two fiberglass sheets sandwiching the foam core, one of the two fiberglass sheets having one or more flanges that extend perpendicular to the fiberglass sheet, the one or more flanges defining a plurality of spaced apertures that align with the plurality of floor panel apertures of the one or more floor panels, each of the one or more flanges having a first portion parallel to the exterior wall panel and a second portion perpendicular to the exterior wall panel, the second portion defining the plurality of spaced apertures.

21. The exterior wall panel of claim 20, wherein the one or more flanges extend about an entire perimeter of the fiberglass sheet.

* * * * *